US012649212B2

(12) United States Patent
Liou

(10) Patent No.: US 12,649,212 B2
(45) Date of Patent: Jun. 9, 2026

(54) SHOCK-ABSORBING HOUSING FOR AN ELECTRIC TOOL

(71) Applicant: BASSO INDUSTRY CORP., Taichung (TW)

(72) Inventor: Guey-Horng Liou, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 0 days.

(21) Appl. No.: 19/283,797

(22) Filed: Jul. 29, 2025

(65) Prior Publication Data

US 2026/0042185 A1 Feb. 12, 2026

(30) Foreign Application Priority Data

Aug. 8, 2024 (TW) ..... 113208529

(51) Int. Cl.
*B25F 5/02* (2006.01)
*B24B 41/00* (2006.01)

(52) U.S. Cl.
CPC ..... *B24B 41/007* (2013.01)

(58) Field of Classification Search
CPC ..... B25F 5/006; B25F 5/02; B24B 41/007
See application file for complete search history.

(56) References Cited

U.S. PATENT DOCUMENTS 3,845,557 A * 11/1974 Bailey ..... F16F 15/08 267/141
5,273,120 A * 12/1993 Chang ..... B25F 5/006 16/431
5,692,574 A * 12/1997 Terada ..... B25D 17/043 173/162.2
5,697,456 A * 12/1997 Radle ..... B25D 17/043 173/162.2
5,738,177 A * 4/1998 Schell ..... B25B 23/14 173/181
6,199,383 B1 * 3/2001 Pusateri ..... B25B 21/00 173/171
6,286,610 B1 * 9/2001 Berger ..... B25F 5/006 173/162.1
6,729,414 B2 * 5/2004 Cooper ..... B25F 5/02 173/217
6,796,386 B2 * 9/2004 Izumisawa ..... B25F 5/00 173/93.5

(Continued)

*Primary Examiner* — Gloria R Weeks
(74) *Attorney, Agent, or Firm* — Burris Law, PLLC

(57) ABSTRACT

A shock-absorbing housing for an electric tool includes a shell unit and a shock-absorption unit connected to the shell unit. The shell unit includes limiting portions each having a first hole-defining section that defines a first hole, and a second hole-defining section that defines a second hole. The first hole has a diameter greater than that of the second hole. The shock-absorption unit includes elastic bodies. Each of the elastic bodies includes a first compressive section that extends through the first hole and that is spaced apart from the first hole-defining section, and a second compressive section that is opposite to the first compressive section and that extends through the second hole. The first compressive section has a protruding portion that protrudes outwardly from the first hole-defining section, and that is adapted for abutting against a trigger device of the electric tool.

10 Claims, 9 Drawing Sheets

(56) References Cited

U.S. PATENT DOCUMENTS

| | | | | |
|---|---|---|---|---|
| 7,018,142 | B2 * | 3/2006 | Cooper | B25F 5/02 408/124 |
| 7,090,032 | B2 * | 8/2006 | Wada | B25B 21/02 173/205 |
| 7,185,640 | B2 * | 3/2007 | Shears | F02M 25/089 123/519 |
| 8,281,874 | B2 * | 10/2012 | Imada | B25F 5/006 173/162.2 |
| 8,672,305 | B2 * | 3/2014 | Wolf | F16F 1/3732 267/141 |
| 8,714,280 | B2 * | 5/2014 | Moreno | B25D 17/043 173/210 |
| 8,966,773 | B2 * | 3/2015 | Gregorich | B25F 5/006 30/392 |
| 9,016,672 | B2 * | 4/2015 | Englund | F16F 3/10 267/136 |
| 9,266,217 | B2 * | 2/2016 | Esenwein | B24B 41/007 |
| 9,545,713 | B2 * | 1/2017 | Johnson | B25F 5/006 |
| 11,045,938 | B2 * | 6/2021 | Iwakami | B24B 23/04 |
| 11,577,376 | B2 * | 2/2023 | Tamura | B25F 5/006 |
| 11,813,729 | B2 * | 11/2023 | Kuehne | B25F 5/001 |
| 12,021,437 | B2 * | 6/2024 | Duncan | B24B 41/007 |
| 12,172,284 | B2 * | 12/2024 | Machida | B25D 17/043 |
| 12,533,785 | B2 * | 1/2026 | Craig | B25D 17/06 |
| 2002/0096341 | A1 * | 7/2002 | Hagan | B25B 23/14 173/217 |
| 2005/0155778 | A1 * | 7/2005 | Ishida | B25F 5/02 173/217 |
| 2007/0246237 | A1 * | 10/2007 | Homsi | B25F 5/006 173/213 |
| 2015/0290791 | A1 * | 10/2015 | Takahashi | B25F 5/02 173/170 |

* cited by examiner

SHOCK-ABSORBING HOUSING FOR AN ELECTRIC TOOL

CROSS-REFERENCE TO RELATED APPLICATION

This application claims priority to Taiwanese Utility Model Application No. 113208529, filed on Aug. 8, 2024, the entire disclosure of which is incorporated by reference herein.

FIELD

The disclosure relates to a housing, and more particularly to a shock-absorbing housing for an electric tool.

BACKGROUND

Referring to FIGS. 1 and 2, a conventional electric tool 1 includes a housing 11, a switch 12 mounted in the housing 11, and a protection layer 13 connected to the housing 11. The protective layer 13 includes a plurality of elastic bodies 131 that extend through the housing 11 and that support the switch 12. Each of the elastic bodies 131 has a protruding portion 132 that protrudes from an inner surface of the housing 11 in an axis direction (X) and that is adapted to be pushed by the switch 12 to deform elastically. The protruding portions 132 of the elastic bodies 131 absorb vibration energy, thereby extending the service life of the switch 12.

The housing 11 is generally formed by two shells 111 that are secured to each other by bolts (not shown). Each of the shells 111 is spaced apart from the switch 12 with a gap (d1) therebetween in the axis direction (X) such that the protruding portions 132 of the elastic bodies 131 are accommodated in the gap (d1). However, the gap (d1) between each shell 111 and the switch 12 often varies due to difficulty in precisely controlling the torque for each bolt.

For example, when the gap (d1) between each shell 111 and the switch 12 is 0.15 mm, an original length (d2) (i.e., unpressed length) of the protruding portion 132 in the axis direction (X) is 0.5 mm, and a compression length (d3) (i.e., an amount of compression) of each of the protruding portions 132 in the axis direction (X) is 0.35 mm, a compression ratio of each protruding portion 132 can be calculated and preset to be 0.35/0.5=70%.

However, in practice, the gap (d1) between each shell 111 and the switch 12 may vary from 0.3 mm to 0.05 mm, the resulting tolerance is approximately 0.25 mm, so that the compression length (d3) of each protruding portion 132 may vary from 0.2 mm to 0.45 mm. As a result, the compression ratio of the protruding portion 132 may vary in a range from 40% (0.2/0.5) to 90% (0.45/0.5), which significantly deviates from the preset compression ratio of 70%. If the compression ratio is too high, the protruding portion 132 may become over-compressed and lose its elasticity, resulting in a technical problem.

If the protruding portion 132 is designed with a reduced original length (d2) to avoid the technical problem associated with the high compression ratio, the aforementioned tolerance may result in no actual compression of the protruding portion 132, thereby leading to a poor shock absorption effect. Therefore, determining an appropriate length of the elastic bodies 131 involves a trade-off and presents a design dilemma.

Similar configuration and technical problems are also seen in U.S. Pat. No. 9,266,217.

SUMMARY

Therefore, an object of the disclosure is to provide a shock-absorbing housing for an electric tool that can alleviate at least one of the drawbacks of the prior art.

According to the disclosure, a shock-absorbing housing for an electric tool includes a shell unit and a shock-absorption unit.

The electric tool includes an electric device that converts electric energy into kinetic energy, a power unit that outputs the kinetic energy, and a trigger device that is operable to activate the electric device.

The shell unit includes two shells that are arranged in a first direction, that are connected to each other, and that cooperatively define a mounting space adapted for accommodating the electric device, the power unit, and the trigger device. Each of the two shells has an inner surface that faces the mounting space, an outer surface that is opposite to the inner surface, and a plurality of limiting portions. The plurality of limiting portions of one of the two shells is respectively aligned with and spaced apart from the plurality of limiting portions of another one of the two shells in the first direction.

Each of the plurality of limiting portions has a first hole-defining section and a second hole-defining section. The first hole-defining section protrudes from the inner surface, is adapted to protrude toward the trigger device, and defines a first hole. The second hole-defining section is opposite to the first hole-defining section and defines a second hole. The first hole has a diameter that is greater than a diameter of the second hole. The first hole and the second hole are adapted to be respectively adjacent to and distal from the trigger device.

The shock-absorption unit is connected to the shell unit and includes a plurality of elastic bodies. The elastic bodies extend in the first direction and respectively through the plurality of limiting portions of the two shells. Each of the plurality of elastic bodies includes a first compressive section that extends through the first hole defined by the first hole-defining section of the respective one of the plurality of limiting portions of the two shells and that is spaced apart from the first hole-defining section of the respective one of the plurality of limiting portions of the two shells, and a second compressive section that is opposite to the first compressive section and that extends through the second hole defined by the second hole-defining section of the respective one of the plurality of limiting portions of the two shells. The first compressive section has a protruding portion that protrudes outwardly from the first hole-defining section of the respective one of the plurality of limiting portions of the two shells. The protruding portions of the first compressive sections of the elastic bodies are adapted for abutting against two lateral surfaces of the trigger device that are opposite to each other in the first direction.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
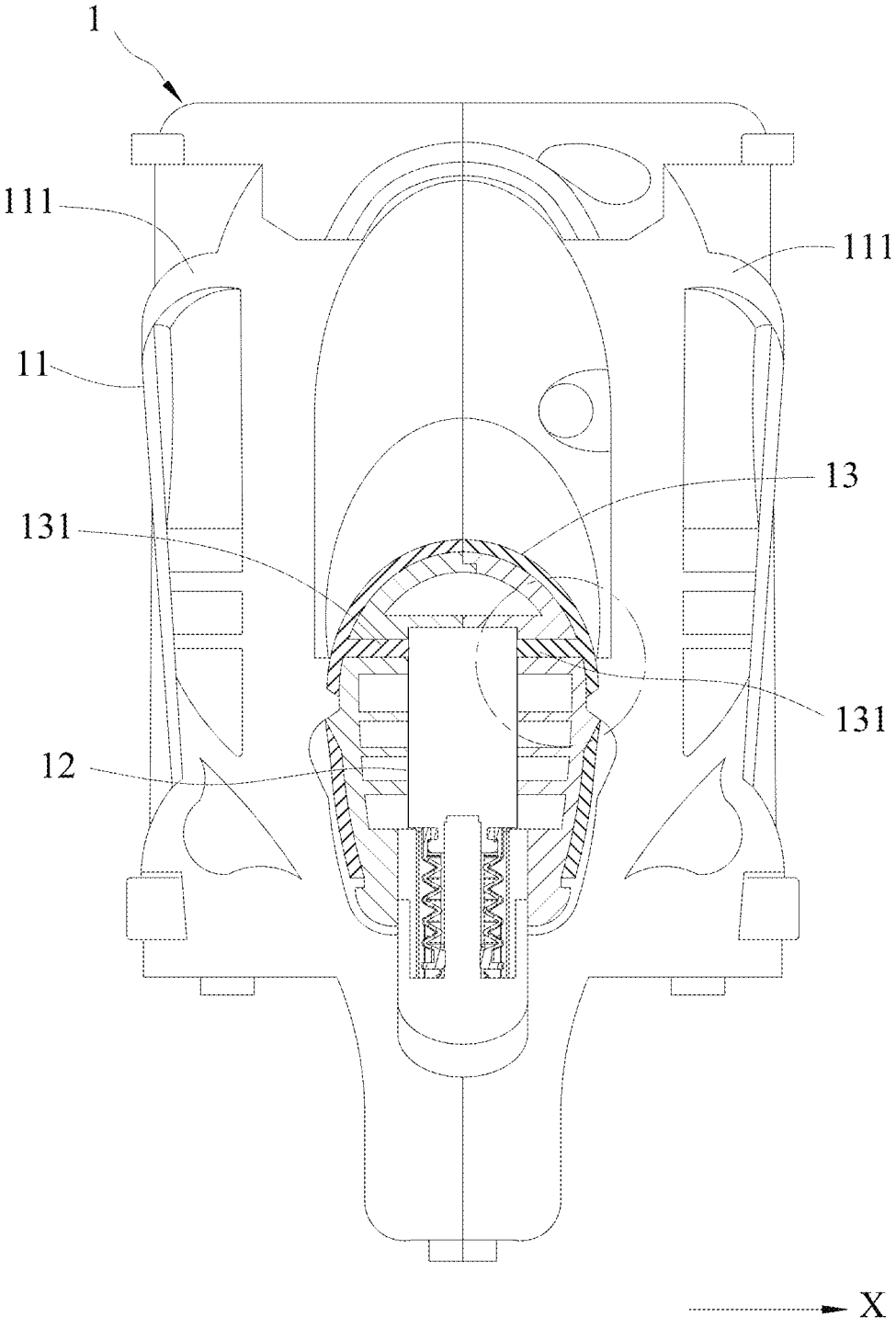
FIG. 1 is a fragmentary sectional view of a conventional electric tool.
Figure 2:
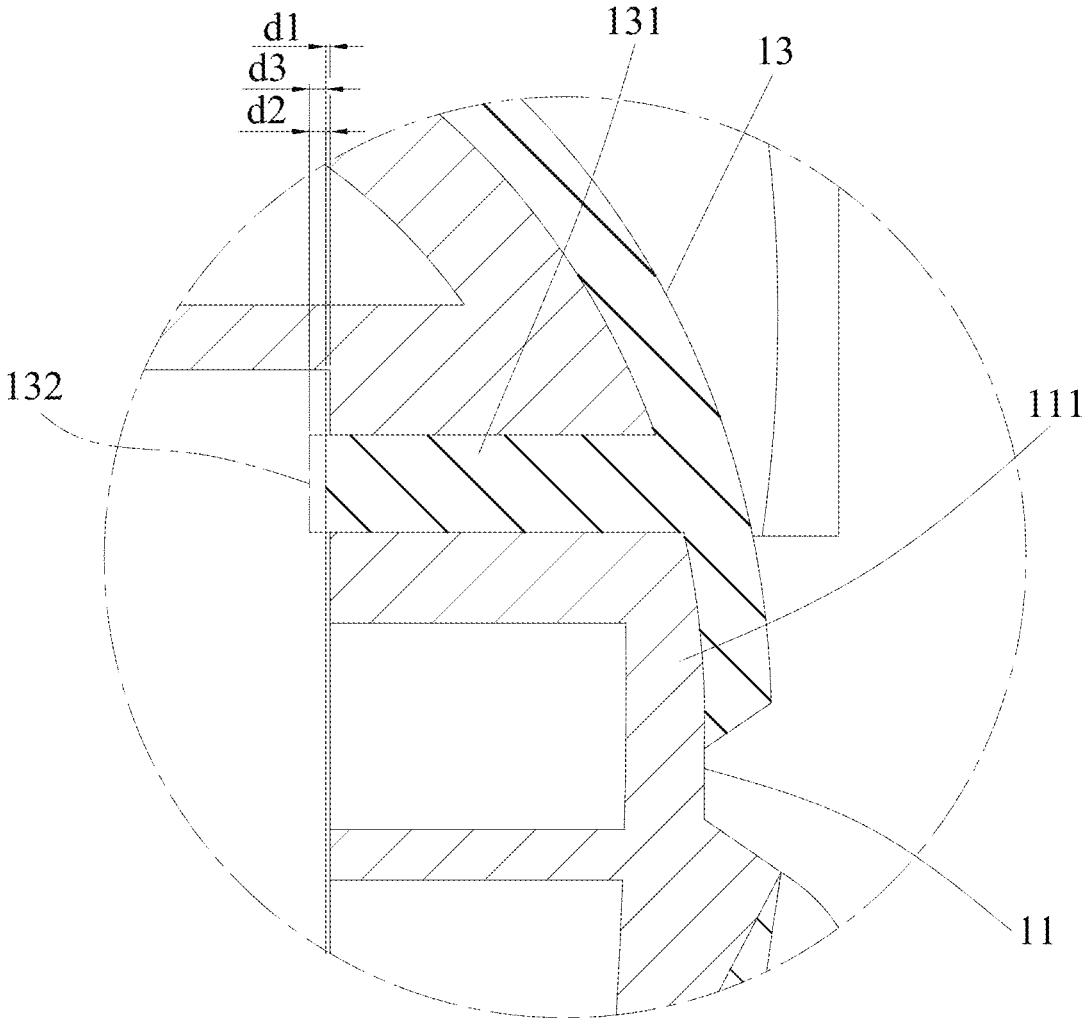
FIG. 2 is a partially enlarged view of FIG. 1.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 3:
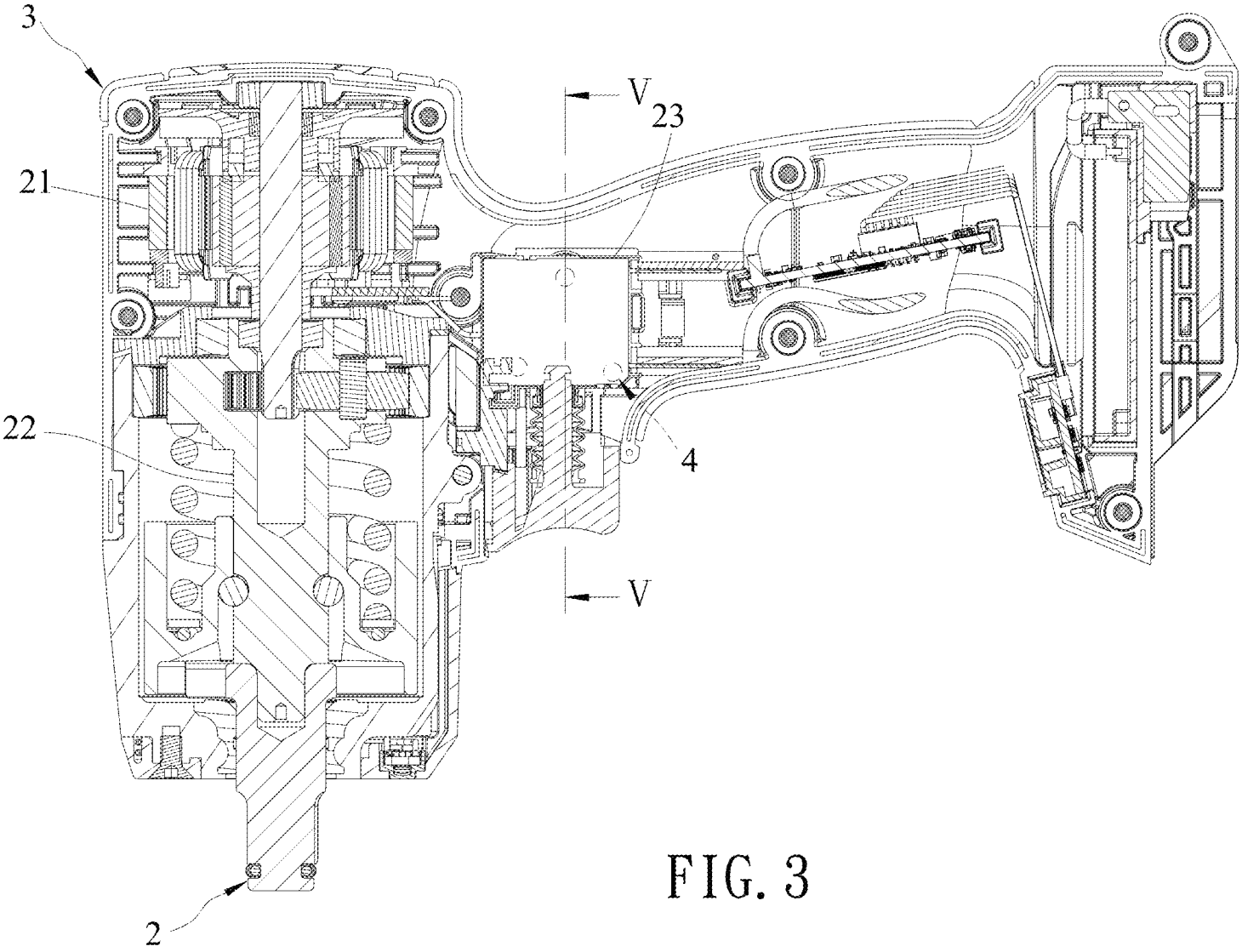
FIG. 3 is a fragmentary sectional view illustrating a first embodiment of a shock-absorbing housing for an electric tool according to the present disclosure, and the electric tool including the shock-absorbing housing.
Figure 4:
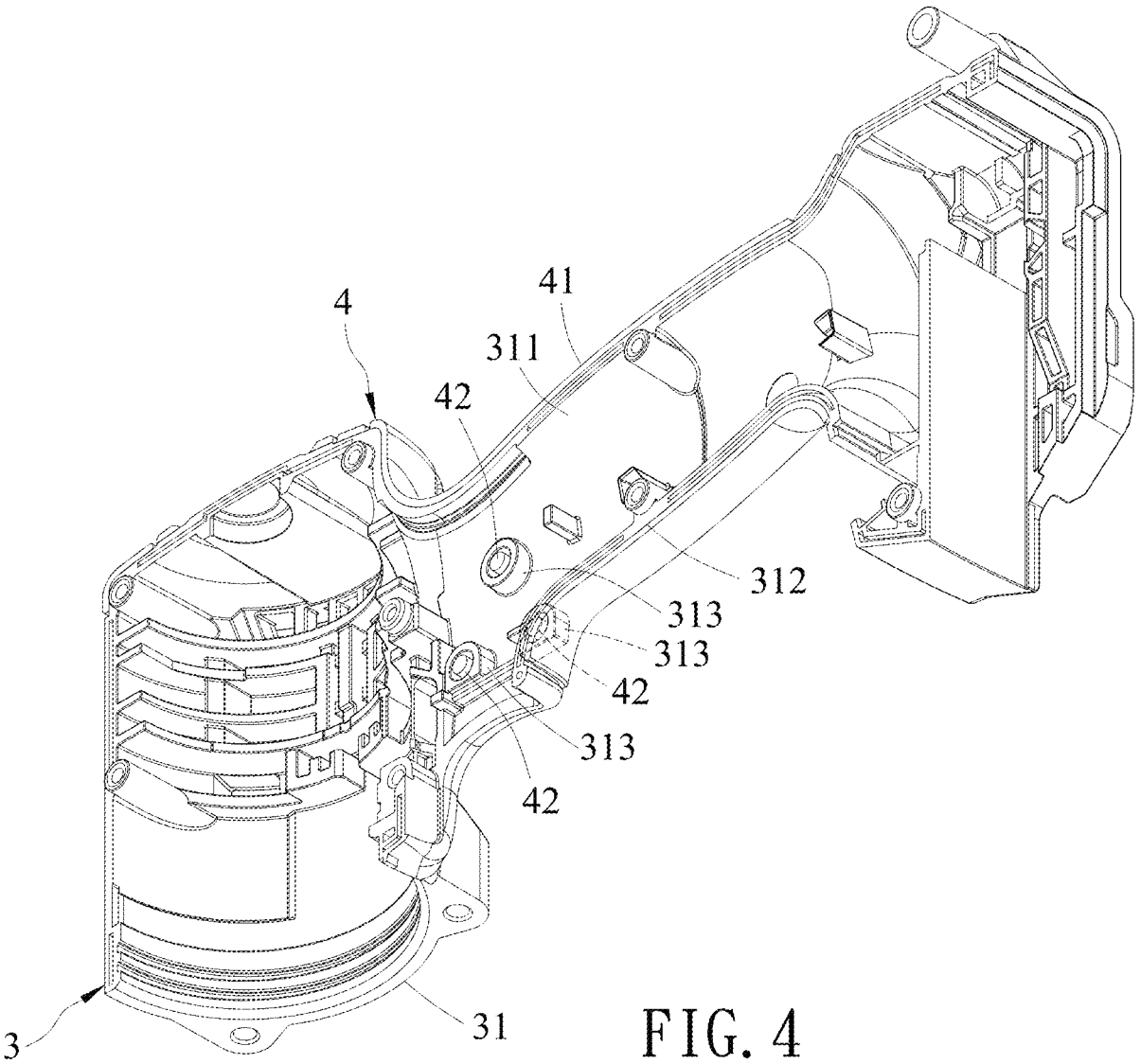
FIG. 4 is a fragmentary perspective view illustrating a shell of the first embodiment.
Figure 5:
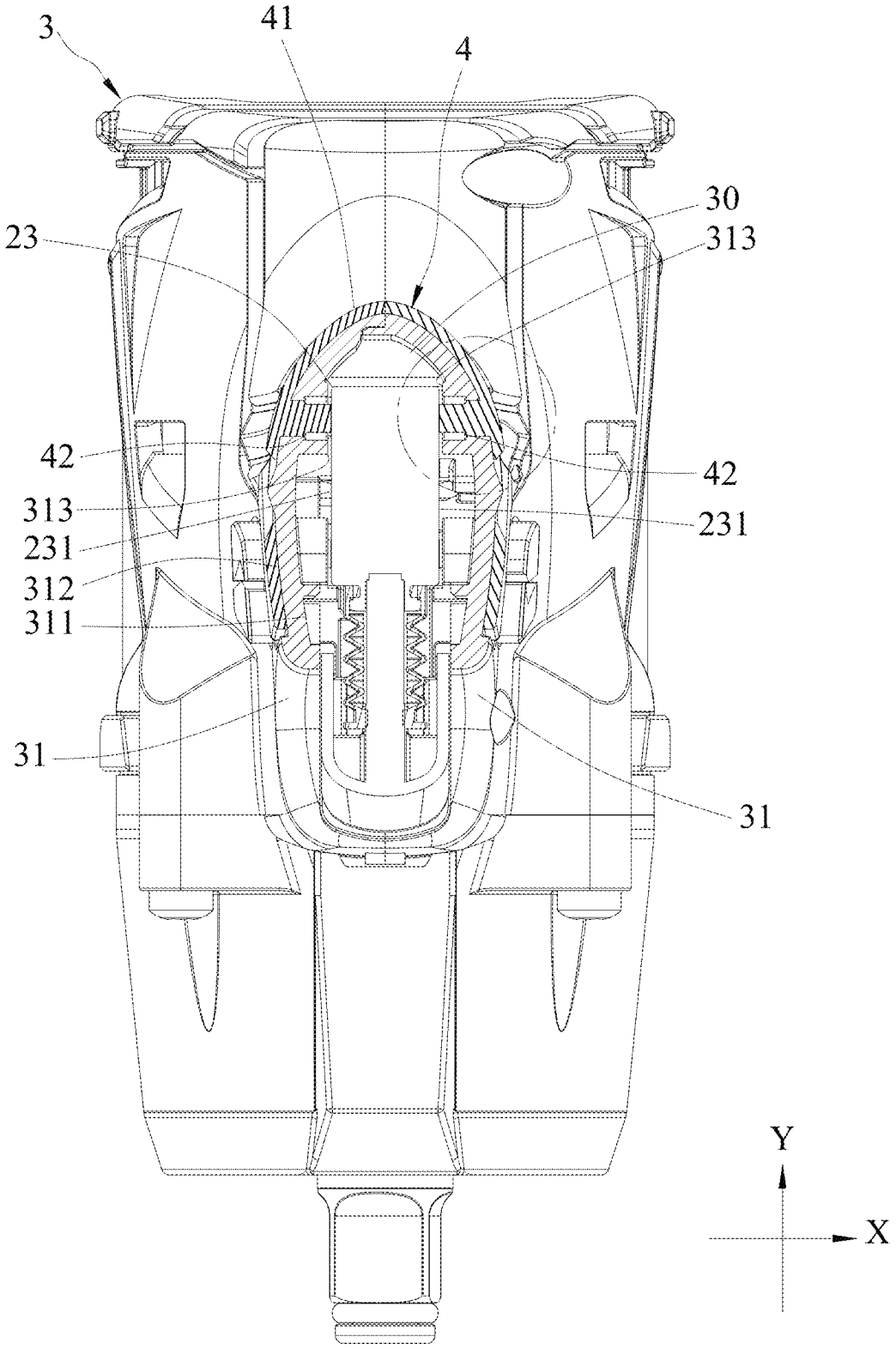
FIG. 5 is a fragmentary sectional view taken along line V-V in FIG. 3.

Referring to FIGS. 3 to 5, a first embodiment of a shock-absorbing housing for an electric tool according to the present disclosure is illustrated. In this embodiment, the shock-absorbing housing is configured as a carrier for accommodating components of the electric tool 2. The electric tool 2 includes an electric device 21 that converts electric energy into kinetic energy, a power unit 22 that outputs the kinetic energy, and a trigger device 23 that is operable to activate the electric devices 21. The electric devices 21, the power unit 22, and the trigger device 23 are mounted in the shock-absorbing housing. The trigger device 23 has two lateral surfaces 231 that are opposite to each other in a first direction (X). The shock-absorbing housing includes a shell unit 3 and a shock-absorption unit 4.

The shell unit 3 includes two shells 31 that are arranged in the first direction (X), that are connected to each other, and that cooperatively define a mounting space 30 adapted for accommodating the electric device 21, the power unit 22, and the trigger device 23. Each of the shells 31 has an inner surface 311 that faces the mounting space 30, an outer surface 312 that is opposite to the inner surface 311, and a plurality of limiting portions 313 that extend from the inner surface 311 into the mounting space 30. In this embodiment, each of the shells 31 has three of the limiting portions 313. The limiting portions 313 of one of the two shells 31 are respectively aligned with and spaced apart from the limiting portions 313 of another one of the two shells 31 in the first direction (X). It should be noted that, in this embodiment, the shells 31 are fastened to each other by bolts (not shown).

Figure 6:
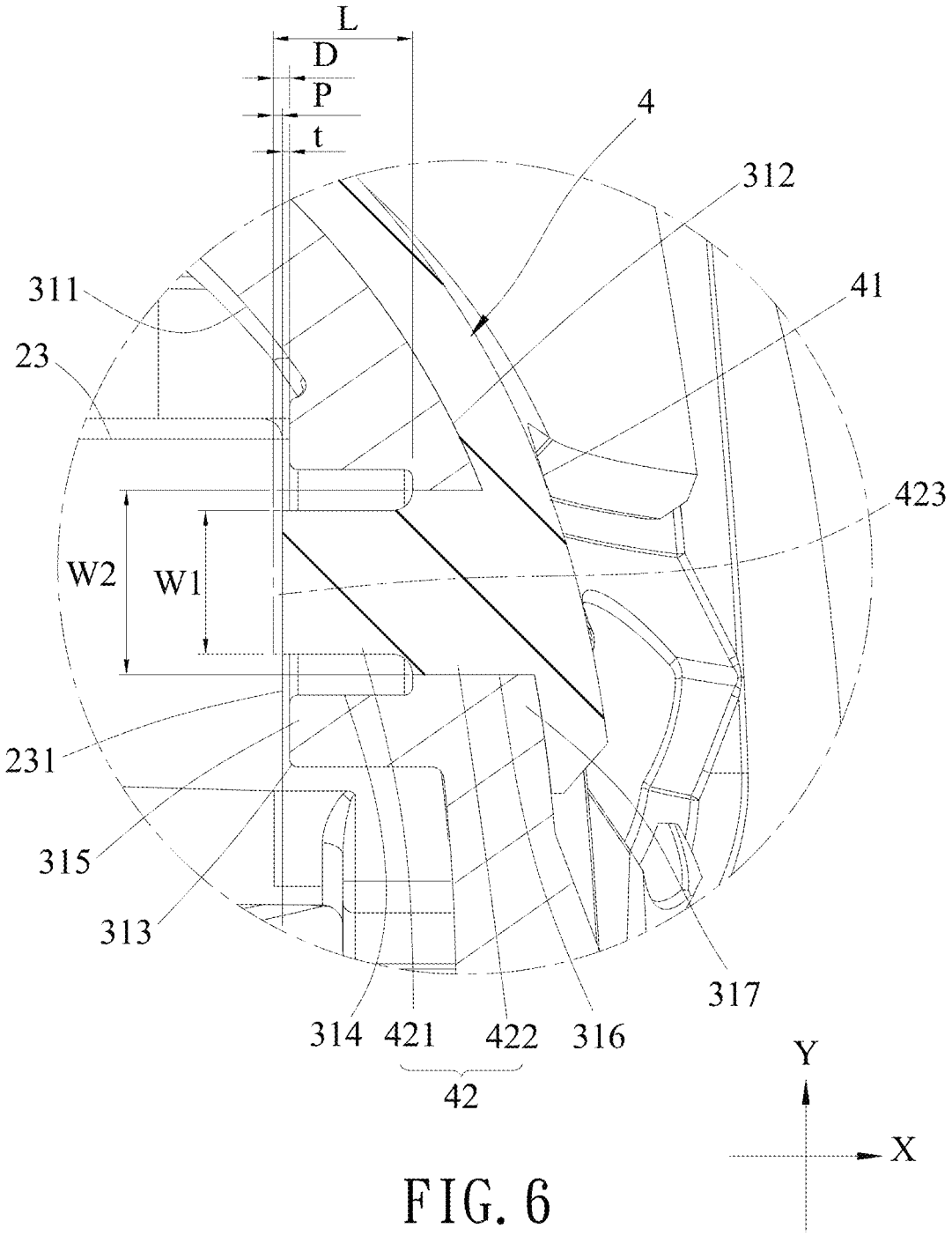
FIG. 6 is a partially enlarged view of FIG. 5.

Referring to FIG. 6, each of the limiting portions 313 has a first hole-defining section 315 and a second hole-defining section 317. The first hole-defining section 315 protrudes from the inner surface 311, is adapted to protrude toward the trigger device 23, and defines a first hole 314 that directly communicates with the mounting space 30. The second hole-defining section 317 is opposite to the first hole-defining section 315 and defines a second hole 316. The first hole 314 has a diameter that is greater than a diameter of the second hole 316. The first hole 314 and the second hole 316 are adapted to be respectively adjacent to and distal from the trigger device 23. In this embodiment, the second hole-defining section 317 of each of the limiting portions 313 extends through the outer surface 312, and the second hole 316 defined by the second hole-defining section 317 of each of the limiting portions 313 communicates with the first hole 314 defined by the first hole-defining section 315 of the each of the limiting portions 313. The first hole-defining section 315 of each of the limiting portions 313 is adapted to cooperate with one of the two lateral surfaces 231 of the trigger device 23 to define a gap (t) therebetween.

Referring to FIGS. 4 to 6, the shock-absorption unit 4 is connected to the shell unit 3, and includes a protective layer 41 that covers the outer surfaces 312 of the shells 31, and a plurality of elastic bodies 42 that are formed integrally with the protective layer 41. In this embodiment, the shock-absorption unit 4 includes six of the elastic bodies 42, and each of the elastic bodies 42 is made of rubber. The elastic bodies 42 extends in the first direction (X) and respectively through the limiting portions 313 of the two shells 31.

Each of the elastic bodies 42 includes a first compressive section 421 that extends through the first hole 314 defined by the first hole-defining section 315 of the respective one of the limiting portions 313 of the two shells 31 and that is spaced apart from the first hole-defining section 315 of the respective one of the limiting portions 313 of the two shells 31, and a second compressive section 422 that is opposite to the first compressive section 421 and that extends through the second hole 316 defined by the second hole-defining section 317 of the respective one of the limiting portions 313 of the two shells 31. In this embodiment, the second compressive section 422 of each of the elastic bodies 42 is fittingly engaged with the second hole-defining section 317 of the respective one of the limiting portions 313 of the shells 31. For each of the elastic bodies 42, the first compressive section 421 has a first maximum width (W1) in a second direction (Y) that is substantially perpendicular to the first direction (X), and the second compressive section 422 has a second maximum width (W2) in the second direction (Y). The second maximum width (W2) is greater than the first maximum width (W1). The first compressive section 421 has a protruding portion 423 that protrudes outwardly from the first hole-defining section 315 of the respective one of the limiting portions 313 of the two shells 31. The protruding portions 423 of the first compressive sections 421 of the elastic bodies 42 are adapted for abutting against the two lateral surfaces 231 of the trigger device 23 in the first direction (X).

For each of the elastic bodies 42, a ratio of a length (L) of the first compressive section 421 in the first direction (X) to a length (D) of the protruding portion 423 in the first direction (X) ranges from 1:7 to 1:8. It is noticed that, each of the length (L) of the first compressive section 421 and the length (D) of the protruding portion 423 is an unpressed length thereof.

A ratio of the gap (t) to the length (L) of the first compressive section 421 of each of the elastic bodies 42 ranges from 1:12.6 to 1:76.

A ratio of the gap (t) to the length (D) of the protruding portion 423 of the first compressive section 421 of each of the elastic bodies 42 ranges from 1:1.6 to 1:10.

It is to be noted that, for each of the elastic bodies 42, although only the protruding portion 423 is adapted to abut against the trigger device 23, the first compressive section 421 is spaced apart from the first hole-defining section 315 of the respective one of the limiting portions 313 of the shells 31, so that the entire first compressive section 421 may be compressed and deformed to absorb vibration energy.

For example, when the gap (t) is 0.15 mm, the length (L) of the first compressive section 421 is 3.8 mm, and a compression length (P) (i.e., an amount of compression) of each of the protruding portions 423 in the first direction (X) is 0.35 mm, a compression ratio of the first compressive section 421 can be calculated and preset to be 0.35/3.8=9.2%.

In practice, when the gap (t) varies from 0.3 mm to 0.05 mm, the resulting tolerance is approximately 0.25 mm, so that the compression length (P) of each of the protruding portions 423 varies from 0.2 mm to 0.45 mm; nonetheless, the compression ratio of each of the first compressive sections 421 is in a range from 5.2% (0.2/3.8) to 11.8% (0.45/3.8), which does not significantly deviate from the preset compression ratio of 9.2%. Accordingly, in this embodiment, by reducing the compression ratio of the first compressive section 421, excessive compression of the protruding portion 423 may be prevented, even when the shells 31 are formed with dimensional tolerances.

Figure 7:
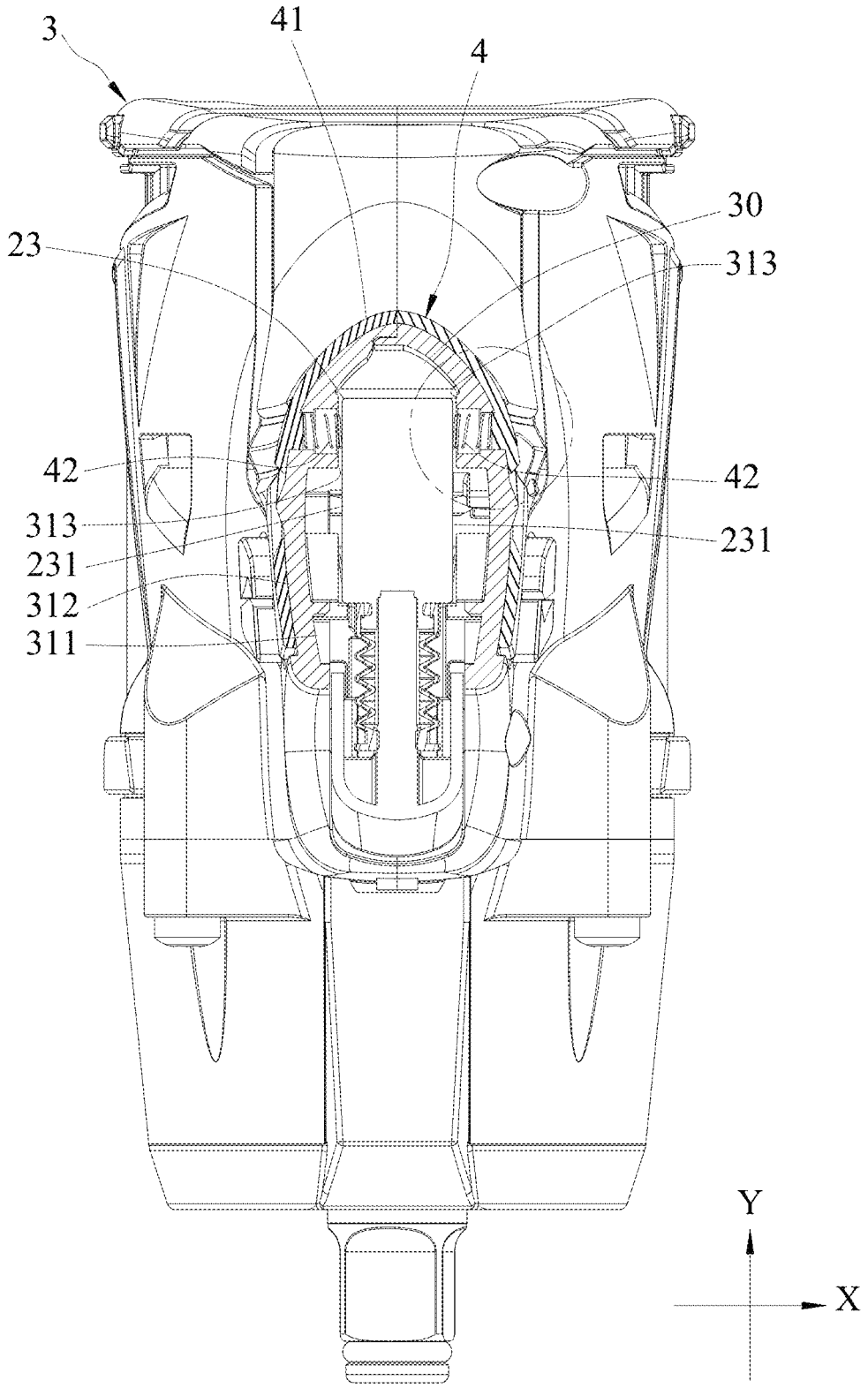
FIG. 7 is a fragmentary sectional view illustrating a second embodiment of the shock-absorbing housing for an electric tool according to the present disclosure, and the electric tool including the shock-absorbing housing.
Figure 8:
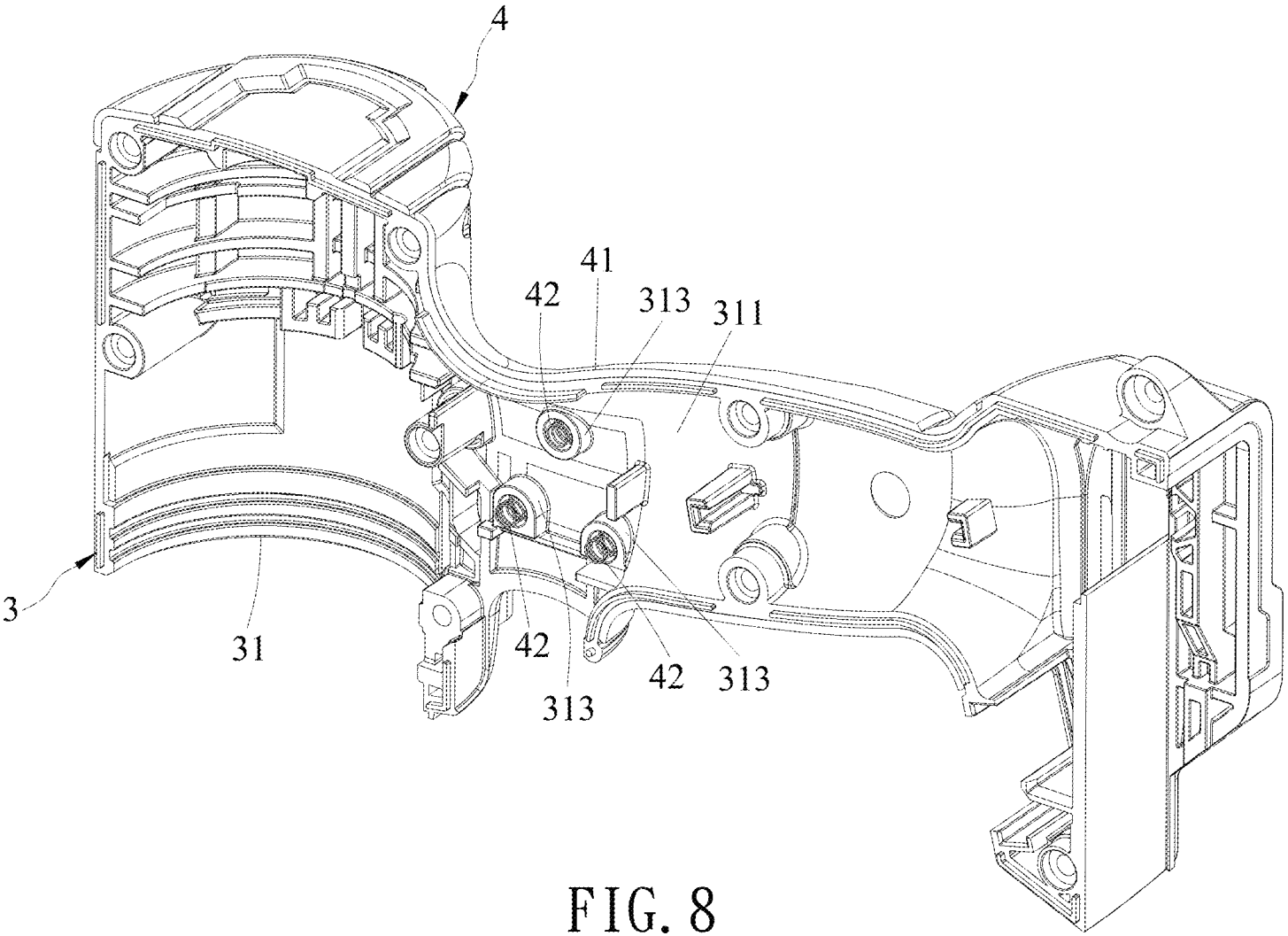
FIG. 8 is a fragmentary perspective view of the second embodiment.
Figure 9:
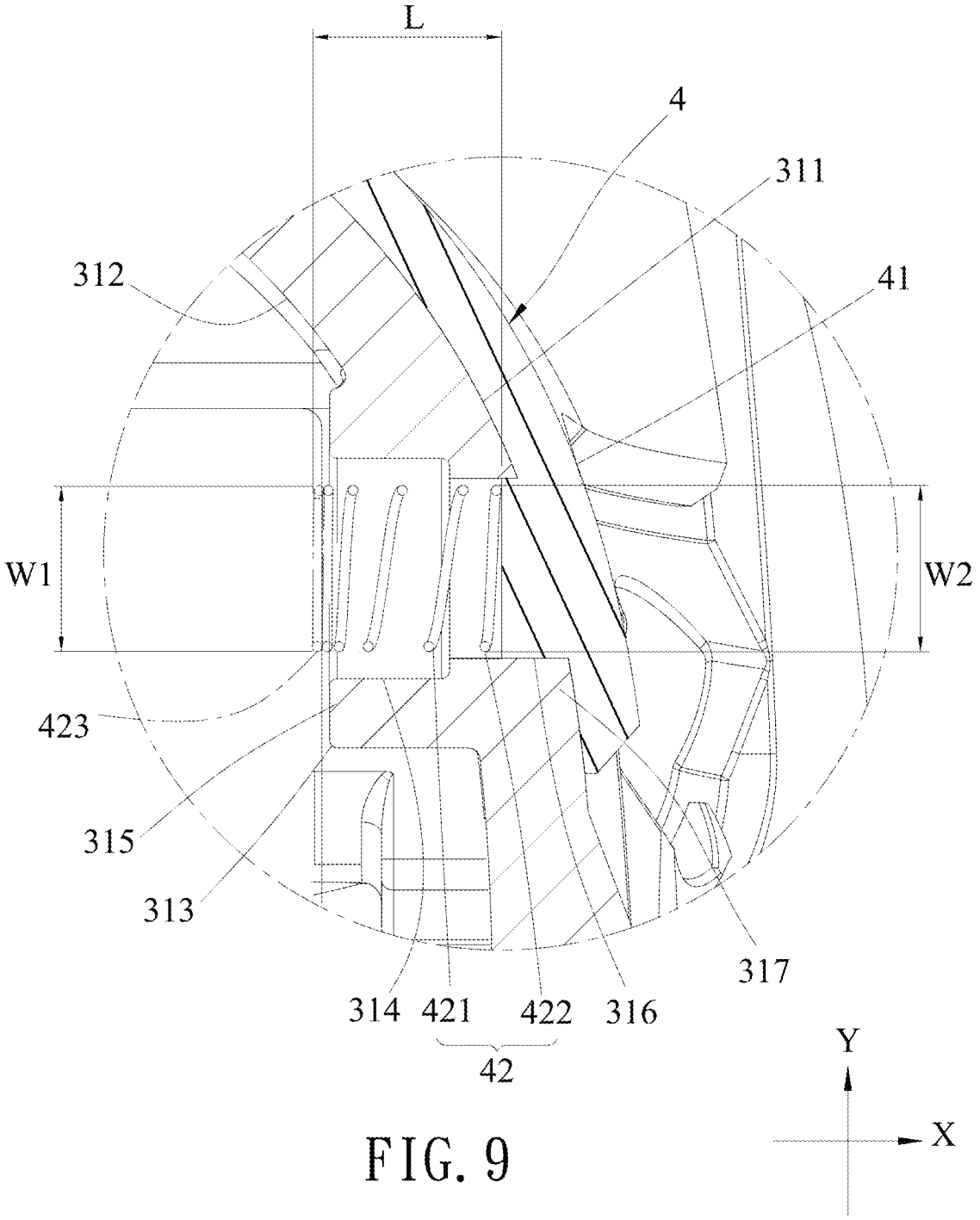
FIG. 9 is a fragmentary partial sectional view of the second embodiment.

Referring to FIGS. 7 to 9, a second embodiment of the shock-absorbing housing for an electric tool according to the present disclosure is illustrated. Similar to the first embodiment, the shock-absorbing housing of this embodiment includes the shell unit 3 and the shock-absorption unit 4; however, the configurations of the shell unit 3 and the shock-absorption unit 4 are different from those in the first embodiment. Particularly, in this embodiment, each of the elastic bodies 42 is configured as a spring and has two opposite ends, one of which is adapted to abut against the trigger device 23, and another of which abuts against the protection layer 41. For each of the elastic bodies 42, the first maximum width (W1) of the first compressive section 421 is equal to the second maximum width (W2) of the second compressive section 422. In this embodiment, the length (L) is defined as the sum of the unpressed lengths of the first compressive section 421 and the second compressive section 422 in the first direction (X).

According to the second embodiment, a lower compression ratio of each of the first compressive sections 421 may be obtained. Accordingly, as well as the first embodiment, excessive compression of the protruding portion 423 may be prevented, even when the shells 31 are formed with dimensional tolerances.

The advantages of the aforementioned embodiments according to the present disclosure can be summarized as follows.

By virtue of the first hole-defining section 315, the first compressive section 421 may be compressed more freely, and the compression ratio of each of the first compressive sections 421 may be effectively reduced. Accordingly, even when the shells 31 are formed with dimensional tolerances, excessive compression of the protruding portion 423 may still be prevented. Therefore, the length (D) of each protruding portion 423 does not need to be shortened for preventing excessive compression of the protruding portion 423, and the compression length (P) of each of the protruding portions 423 may be maintained appropriately, thereby improving shock absorption effect, so the object of the present disclosure may indeed be achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A shock-absorbing housing for an electric tool, the electric tool including an electric device that converts electric energy into kinetic energy, a power unit that outputs the kinetic energy, and a trigger device that is operable to activate the electric device, said shock-absorbing housing comprising:

a shell unit including two shells that are arranged in a first direction, that are connected to each other, and that cooperatively define a mounting space adapted for accommodating the electric device, the power unit and the trigger device, each of said two shells having an inner surface that faces said mounting space, an outer surface that is opposite to said inner surface, and a plurality of limiting portions, said plurality of limiting portions of one of said two shells being respectively aligned with and spaced apart from said plurality of limiting portions of another one of said two shells in said first direction, each of said plurality of limiting portions having a first hole-defining section that protrudes from said inner surface, that is adapted to protrude toward the trigger device, and that defines a first hole, and a second hole-defining section that is opposite to said first hole-defining section and that defines a second hole, said first hole having a diameter that is greater than a diameter of said second hole, said first hole and said second hole being adapted to be respectively adjacent to and distal from the trigger device; and a shock-absorption unit connected to said shell unit and including a plurality of elastic bodies, said elastic bodies extending in said first direction and respectively through said plurality of limiting portions of said two shells, each of said plurality of elastic bodies including a first compressive section that extends through said first hole defined by said first hole-defining section of the respective one of said plurality of limiting portions of said two shells and that is spaced apart from said first hole-defining section of the respective one of said plurality of limiting portions of said two shells, and a second compressive section that is opposite to said first compressive section and that extends through said second hole defined by said second hole-defining section of the respective one of said plurality of limiting portions of said two shells, said first compressive section having a protruding portion that protrudes outwardly from said first hole-defining section of the respective one of said plurality of limiting portions of said two shells, said protruding portions of said first compressive sections of said elastic bodies being adapted for abutting against two lateral surfaces of the trigger device that are opposite to each other in said first direction.

2. The shock-absorbing housing as claimed in claim 1, wherein said second compressive section of each of said plurality of elastic bodies is fittingly engaged with said second hole-defining section of the respective one of said plurality of limiting portions of said two shells.

3. The shock-absorbing housing as claimed in claim 2, wherein said second hole-defining section of each of said plurality of limiting portions extends through said outer surface, and said second hole defined by said second hole-defining section of each of said plurality of limiting portions communicates with said first hole defined by said first hole-defining section of said each of said plurality of limiting portions.

4. The shock-absorbing housing as claimed in claim 3, wherein each of said plurality of elastic bodies is made of rubber.

5. The shock-absorbing housing as claimed in claim 4, wherein said shock-absorption unit further includes a protection layer that is formed integrally with said plurality of elastic bodies and that covers said outer surfaces of said two shells.

6. The shock-absorbing housing as claimed in claim 1, wherein each of said plurality of elastic bodies is configured as a spring and is adapted to abut against said trigger device.

7. The shock-absorbing housing as claimed in claim 1, wherein, for each of said elastic bodies, a ratio of a length of said first compressive section in said first direction to a length of said protruding portion in said first direction ranges from 1:7 to 1:8.

8. The shock-absorbing housing as claimed in claim 7, wherein:

said first hole-defining section of each of said limiting portions is adapted to cooperate with one of the two lateral surfaces of the trigger device to define a gap therebetween; and a ratio of said gap to said length of said first compressive section of each of said elastic bodies ranges from 1:12.6 to 1:76.

9. The shock-absorbing housing as claimed in claim 7, wherein:

said first hole-defining section of each of said limiting portions is adapted to cooperate with one of the two lateral surfaces of the trigger device to define a gap therebetween; and a ratio of said gap to said length of said protruding portion of said first compressive section of each of said elastic bodies ranges from 1:1.6 to 1:10.

10. The shock-absorbing housing as claimed in claim 1, wherein, for each of said elastic bodies, said first compressive section has a first maximum width in a second direction that is substantially perpendicular to said first direction, and said second compressive section has a second maximum width in said second direction, said second maximum width being greater than said first maximum width.

* * * * *